US008456409B2

(12) United States Patent
Ko et al.

(10) Patent No.: US 8,456,409 B2
(45) Date of Patent: Jun. 4, 2013

(54) GATE DRIVE CIRCUIT AND DISPLAY APPARATUS HAVING THE SAME

(75) Inventors: Gwang-Bum Ko, Asan-si (KR); Won-Hee Lee, Seoul (KR); Ho-Kyoon Kwon, Seoul (KR); Byoung-Sun Na, Hwaseong-si (KR); Ju-Hee Lee, Cheonan-si (KR); Ji-Hyun Kwon, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 748 days.

(21) Appl. No.: 12/533,821

(22) Filed: Jul. 31, 2009

(65) Prior Publication Data

US 2010/0201668 A1 Aug. 12, 2010

(30) Foreign Application Priority Data

Feb. 11, 2009 (KR) ..... 10-2009-0010903

(51) Int. Cl.
*G09G 3/36* (2006.01)

(52) U.S. Cl.
USPC ..... 345/100; 345/204

(58) Field of Classification Search
USPC ..... 345/55, 87, 204, 211, 99, 100; 327/108
See application file for complete search history.

(56) References Cited

U.S. PATENT DOCUMENTS

| | | | | |
|---|---|---|---|---|
| 2005/0275614 | A1* | 12/2005 | Kim et al. | 345/100 |
| 2006/0061562 | A1* | 3/2006 | Park et al. | 345/204 |
| 2007/0296662 | A1* | 12/2007 | Lee et al. | 345/87 |
| 2007/0296681 | A1* | 12/2007 | Kim et al. | 345/100 |
| 2008/0048712 | A1* | 2/2008 | Ahn et al. | 326/21 |
| 2008/0055225 | A1* | 3/2008 | Pak et al. | 345/96 |

FOREIGN PATENT DOCUMENTS

| | | |
|---|---|---|
| KR | 1020050121357 | 12/2005 |
| KR | 1020070121071 | 12/2007 |
| KR | 1020080057601 | 6/2008 |

OTHER PUBLICATIONS

English Abstract for Publication No. 1020050121357.
English Abstract for Publication No. 1020070121071.
English Abstract for Publication No. 1020080057601.

* cited by examiner

*Primary Examiner* — Chanh Nguyen
*Assistant Examiner* — Pegeman Karimi
(74) *Attorney, Agent, or Firm* — F. Chau & Associates, LLC

(57) ABSTRACT

Gate drive circuit includes a plurality of stages connected one after another to each other. An m-th stage includes a pull-up section outputting a first clock signal as a gate signal of the m-th stage to an output terminal, a pull-down section applying a low voltage to the output terminal, a carry section outputting the first clock signal as a carry signal of the m-th stage in response to the high voltage of the first node signal, a first carry holding section maintaining the carry signal of the m-th stage at the low voltage in response to the high voltage of the first clock signal and a second carry holding section maintaining the carry signal of the m-th stage at the low voltage in response to a high voltage of the second clock signal.

16 Claims, 12 Drawing Sheets

GATE DRIVE CIRCUIT AND DISPLAY APPARATUS HAVING THE SAME

CROSS-REFERENCE TO RELATED APPLICATION

This application claims priority under 35 U.S.C. §119 to and the benefit of Korean Patent Application No. 2009-10903, filed on Feb. 11, 2009 in the Korean Intellectual Property Office (KIPO), the entire contents of which are incorporated by reference herein.

BACKGROUND OF THE INVENTION

1. Field of the Invention

The present disclosure relates to display devices, and more particularly to gate drive circuits for the display devices and a display apparatus having the gate drive circuits.

2. Discussion of the Related Art

Recently, amorphous silicon gate (ASG) technology has been employed to reduce manufacturing costs of a panel module for a display apparatus and the total size of the display apparatus. In the ASG technology, a gate drive circuit is simultaneously formed in a peripheral area of a panel while a switching element is formed in a display area of the panel.

In the ASG technology, since a gate signal is generated by selectively outputting a clock signal, the ASG technology has noise generated by the continuously changing clock signal when the display apparatus is not driven. Accordingly, a structure including various maintenance parts has been developed to minimize the noise generated when the display apparatus is not driven.

However, the ASG technology proposed so far has not effectively controlled the noise generated when the temperature of the gate driving part increases when driven for a long time. As a result, the noise of the gate signal may reduce the display quality of the display apparatus.

SUMMARY OF THE INVENTION

In accordance with exemplary embodiments of the present invention, a gate drive circuit is provided for improving the driving reliability thereof.

In accordance with exemplary embodiments of the present invention, a display apparatus having the above-mentioned gate drive circuit is also provided.

According to an exemplary embodiment of the present invention, a gate drive circuit includes a plurality of stages connected one after another to each other. The plurality of stages output gate signals. An m-th stage ('m' being a natural number) includes a pull-up section, a pull-down section, a carry section, a first carry holding section and a second carry holding section. The pull-up section outputs a first clock signal as a gate signal of the m-th stage to an output terminal in response to a high voltage of a first node signal which is converted to a high level in accordance with a vertical start signal of a carry signal of one of previous stages of the m-th stage. The pull-down section applies a low voltage to the output terminal in response to a high voltage of the gate signal of one of next stages of them-th stage. The carry section outputs the first clock signal as a carry signal of the m-th stage in response to the high voltage of the first node signal. The first carry holding section maintains the carry signal of the m-th stage at the low voltage in response to the high voltage of the first clock signal when the gate signal of the m-th stage is maintained at the low voltage. The second carry holding section maintains the carry signal of the m-th stage at the low voltage in response to a high voltage of the second clock signal having an different phase from the first clock signal.

In an exemplary embodiment of the present invention, the gate drive circuit may further include a third carry holding section maintaining the carry signal of the m-th stage at the low voltage in response to the gate signal of the one of the next stages of the m-th stage.

In an exemplary embodiment of the present invention, the gate drive circuit may further include a switching section having the second node to which the low voltage is applied when the gate signal of the m-th stage is maintained at the high voltage, and to which the first clock signal is applied when the gate signal of the m-th stage is maintained at the low voltage.

In an exemplary embodiment of the present invention, the gate drive circuit may further include a first holding section applying the low voltage to the output terminal in response to the high voltage of the first clock signal applied to the second node and a second holding section apply the low voltage to the output terminal in response to the high voltage of the second clock signal.

In an exemplary embodiment of the present invention, the pull-up section may include a first transistor having a gate electrode connected to the first node, a source electrode connected to the output terminal and a drain electrode connected to a first clock terminal receiving the first clock signal. The holding section may include a second transistor having a gate electrode connected to the second node, a source electrode connected to a voltage terminal receiving the low voltage and a drain electrode connected to the output terminal. The carry section may include a third transistor having a gate electrode connected to the first node, a source electrode connected to a carry terminal outputting the carry signal of the m-th stage to the one of the next stages of the m-th stage and a drain electrode connected to the first clock terminal. The first carry holding section may include a fourth transistor having a gate electrode connected to the second node, a source electrode connected to the voltage terminal and a drain electrode connected to the carry terminal.

In an exemplary embodiment of the present invention, the ratio of the channel width of the second transistor to the channel width of the first transistor may be substantially the same as the ratio of the channel width of the fourth transistor to the channel width of the third transistor.

In an exemplary embodiment of the present invention, the second holding section may include a fifth transistor having a gate electrode connected to the second clock terminal receiving the second clock signal, a source connected to the voltage terminal and a drain electrode connected to the output terminal. The second carry holding section may include a sixth transistor having a gate electrode connected to the second clock terminal, a source electrode connected to the voltage terminal and a drain electrode connected to the carry terminal.

In an exemplary embodiment of the present invention, the ratio of the channel width of the fifth transistor to the channel width of the first transistor may be substantially the same as the ratio of the channel width of the sixth transistor to the channel width of the third transistor.

In an exemplary embodiment of the present invention, the pull-down section may include a seventh transistor having a gate electrode connected to a second input terminal receiving the gate signal of the one of the next stages, a source electrode connected to the voltage terminal and a drain electrode connected to the output terminal. The third carry holding section may include an eighth transistor having a gate electrode connected to the second input terminal, a source electrode connected to the voltage terminal and a drain electrode connected to the carry terminal.

In an exemplary embodiment of the present invention, the ratio of the channel width of the seventh transistor to the channel width of the first transistor may be substantially the same as the ratio of the channel width of the eighth transistor to the channel width of the third transistor.

According to an exemplary embodiment of the present invention, a display apparatus includes a display panel, a data drive circuit and a gate drive circuit. The display panel on which gate lines and data lines cross each other includes a display area displaying an image and a peripheral area surrounding the display area. The data drive circuit outputs data signals to the data lines. The gate drive circuit includes a plurality of stages connected one after another to each other. The plurality of stages output gate signals. An m-th stage ('m' being a natural number) includes a pull-up section, a pull-down section, a carry section, a first carry holding section and a second carry holding section. The pull-up section outputs a first clock signal as a gate signal of the m-th stage to an output terminal in response to a high voltage of a first node signal converted to a high level in accordance with a vertical start signal of a carry signal of one of previous stages of the m-th stage. The pull-down section applies a low voltage to output terminal in response to a high voltage of the gate signal of one of next stages of the m-th stage. The carry section outputs the first clock signal as a carry signal of the m-th stage in response to the high voltage of the first node signal. The first carry holding section maintains the carry signal of the m-th stage at the low voltage in response to the high clock signal when the gate signal of th em-th stage is maintained at the low voltage. The second carry holding section maintains the carry signal of the m-th stage at the low voltage in response to a high voltage of a second clock signal having a different phase from the first clock signal.

According to an exemplary embodiment of the present invention, in a gate drive circuit for driving a display panel for reducing ripple generation between the first stage and a next stage, the first stage includes a pull-up section, a pull-down section, a carry section, a first carry holding section, a second carry holding section and a third carry holding section. The pull-up section outputs a first clock signal as a gate signal of the m-th stage to an output terminal in response to a high voltage of a first node signal which is converted into a high level in accordance with a vertical start signal or a carry signal of one of previous stages of the m-th stage, the pull-up section being a transistor having a pull-up section channel width. The pull-down section applies a low voltage to the output terminal in response to a high voltage of the gate signal of one of next stages of the m-th stage, the pull-down section being a transistor having a pull-down section channel width. The carry section outputs the first clock signal as a carry signal of the m-th stage in response to the high voltage of the first node signal, the carry section being a transistor having a carry section channel width. The first carry holding section maintains the carry signal of the m-th stage at the low voltage in response to the high voltage of the first clock signal when the gate signal of the m-th stage is maintained at the low voltage. The second carry holding section maintains the carry signal of the m-th stage at the low voltage in response to a high voltage of a second clock signal having an different phase from the first clock signal. The third carry holding section maintains the carry signal of the m-th stage at the low voltage in response to the gate signal of the one of the next stages of the m-th stage, the third carry holding section being a transistor having a third carry holding section channel width. A ratio of the third carry holding section channel width to the carry section channel width is substantially the same as a ratio of the pull-down section channel width to the pull-up section channel width.

In accordance with exemplary embodiments of a gate drive circuit and a display apparatus having the gate drive circuit, a carry signal may be stably maintained at a low voltage within a remaining interval period excluding an interval period in which a corresponding gate signal is maintained at a high voltage through a carry holding section, so that a high temperature margin of the gate drive circuit may be improved. Thus, the driving reliability of the gate drive circuit when driven for a long time may be improved.

BRIEF DESCRIPTION OF THE DRAWINGS

Exemplary embodiments of the present invention will now be described with reference to the accompanying drawings, in which.

DETAILED DESCRIPTION OF THE EXEMPLARY EMBODIMENTS

Figure 1:
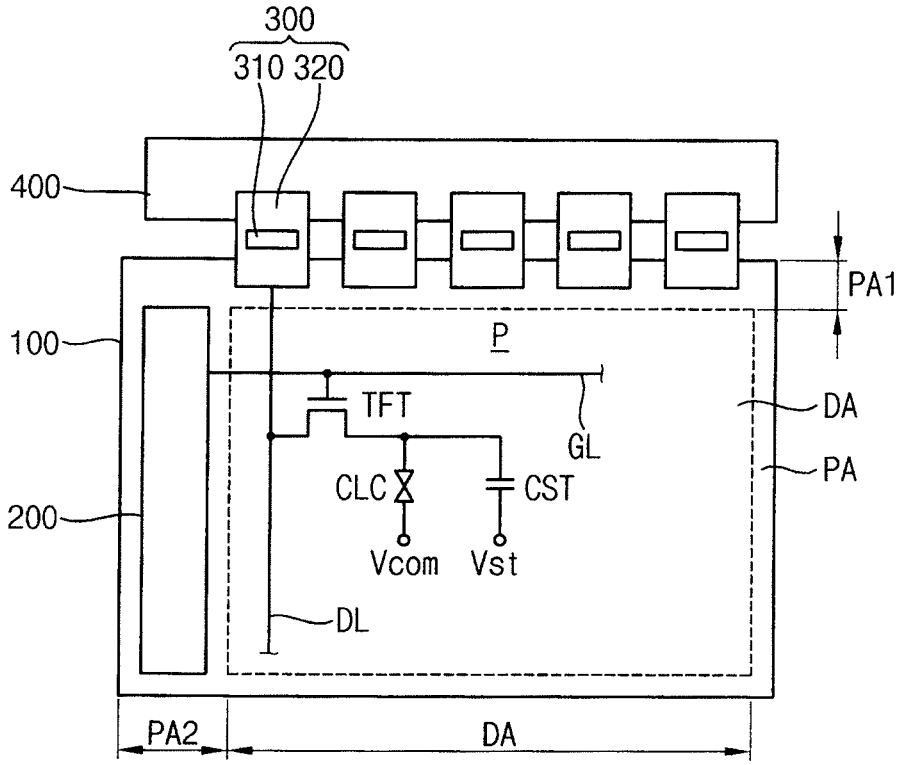
FIG. 1 is a block diagram illustrating a display apparatus according to an exemplary embodiment of the present invention.

The present invention is described more fully hereinafter with reference to the accompanying drawings, in which exemplary embodiments are shown. The present invention may, however, be embodied in many different forms and should not be construed as limited to the exemplary embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present.

Referring now to FIG. 1, the display apparatus includes a display panel 100, a gate drive circuit 200, a data drive circuit 300 and a printed circuit board (PCB) 400.

The display panel 100 includes a display area DA and a peripheral area PA surrounding the display area DA.

A plurality of gate lines GL, a plurality of data lines DL crossing the gate lines GL, and a plurality of pixels P are formed on the display area DA. The gate lines GL extend in a row (long side) direction of the display panel 100, and the data lines DL extend in a column (short side) direction of the display panel 100. Each of the pixels P includes a transistor TFT electrically connected to the gate lines GL and the data lines DL, a liquid crystal capacitor CLC electrically connected to the transistor TFT and a storage capacitor CST. A common voltage Vcom is applied to a common electrode of the liquid crystal capacitor and a storage common voltage Vst is applied to a common electrode of the storage capacitor CST.

The peripheral area PA includes a first peripheral area PA1 positioned at an edge of the long side of the display panel 100 and a second peripheral area PA2 positioned at an edge of the short side of the display panel 100.

A portion of the data drive circuit 300 is disposed in the first peripheral area PA1. The data drive circuit 300 includes a data driving chip 310 outputting data signals to the data lines DL and a flexible printed circuit board (FPCB) 320 on which the data driving chip 310 is mounted. The FPCB 320 includes a first end portion connected to the first peripheral area PA1 of the display panel 100 and a second end portion connected to the PCB 400. The FPCB 320 electrically connects to the PCB 400 and the display panel 100.

In an exemplary embodiment the data driving chip 310 is mounted on the FPCB 320, but is not limited to such an embodiment. The data driving chip 310 may be directly mounted on the display panel 100 or in the first peripheral area PA1 of the display panel 100.

In an exemplary embodiment the gate drive circuit 200 is an integrated circuit (IC) integrated in the second peripheral area PA2 of the display panel 100. The gate drive circuit 200 includes a shift register, in which a plurality of stages are connected one after another to each other, to sequentially output gate signals to the respective gate lines GL.

Figure 2:
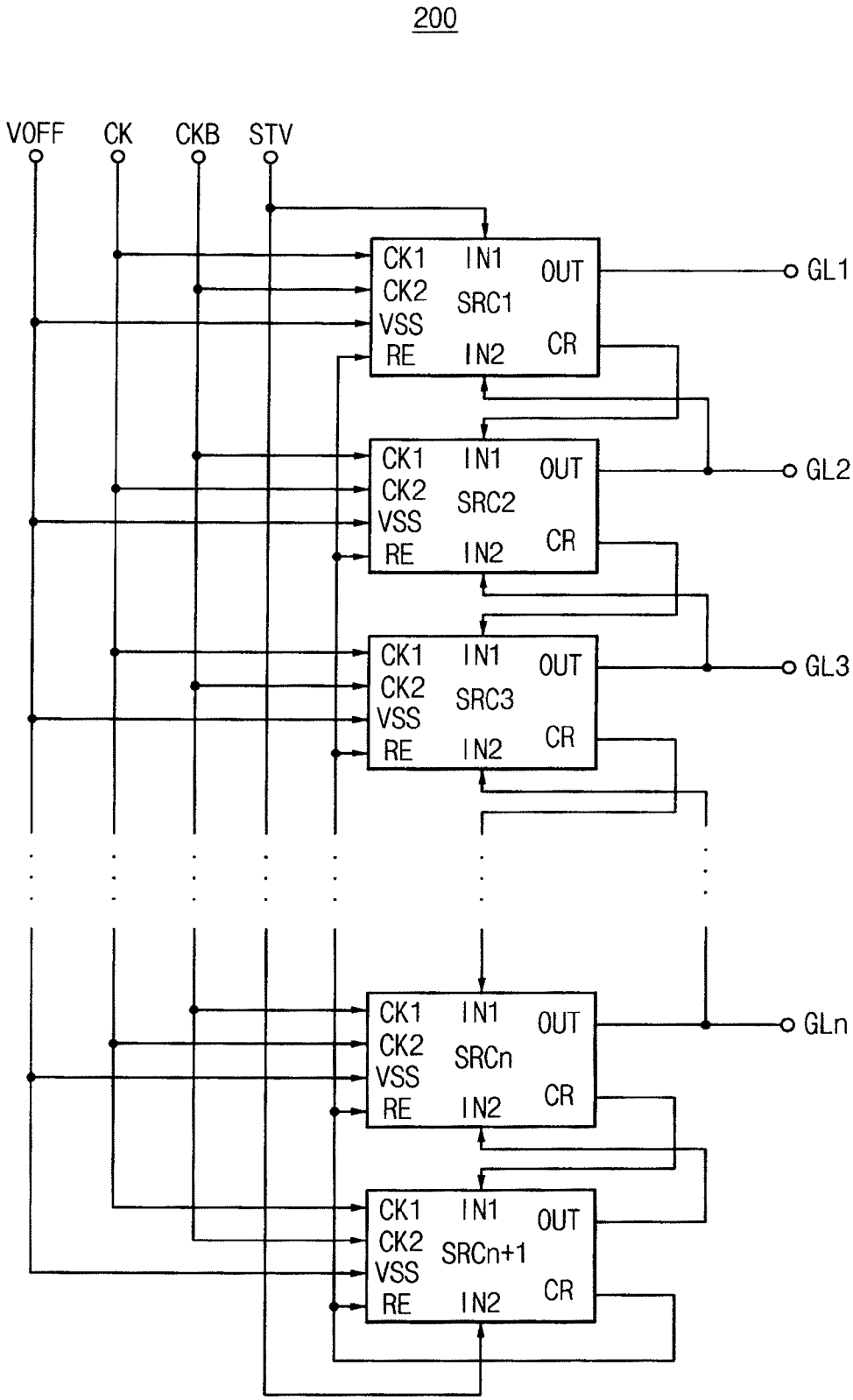
FIG. 2 is a block diagram illustrating a gate drive circuit of FIG. 1.

FIG. 2 is a block diagram illustrating the gate drive circuit 200 of FIG. 1.

Referring to FIGS. 1 and 2, the gate drive circuit 200 includes the shift register in which the plurality of stages SRC1, SRC2, SRC3 . . . SRCn, SRCn+1 are connected one after another to each other. The stages SRC1 to SRCn+1 include n driving stages SRC1 to SRCn and a dummy stage SRCn+1. In the exemplary embodiment, 'n' is a natural number. The n driving stages SRC1 to SRCn are connected to the n gate lines GL1, GL2, GL3 . . . GLn to sequentially output the gate signals to the respective gate lines GL1 to GLn.

Each of the stages includes a first clock terminal CK1, a second clock terminal CK2, a first input terminal IN1, a second input terminal IN2, a voltage terminal VSS, a reset terminal RE, a carry terminal CR and an output terminal OUT.

The first and the second clock terminals CK1, CK2 receive one of a first clock signal CK and a second clock signal CKB having an different phase to the first clock signal CK. In an exemplary embodiment, the first clock signal CK has an opposite phase to the second clock signal. For example, the first clock terminal CK1 of odd-numbered stages SRC1, SRC3, . . . , SRCn+1 receive the first clock signal CK, and the second clock terminal CK2 of the odd-numbered stages SRC1, SRC3, . . . , SRCn+1 receive the second clock signal CKB. However, the first clock terminal CK1 of even-numbered stages SRC2, SRC4 (not shown), . . . , SRCn receive the second clock signal CKB and the second clock terminal CK2 of the even-numbered stages SRC2, SRC4, . . . , SRCn receive the first clock signal CK.

The first input terminal IN1 receives a vertical start signal STV or a carry signal of a previous stage. That is, the first input terminal IN1 of a first stage SRC1 that is a first stage receives the vertical start signal STV, and the first input terminals of a second stage SRC2 to an (n+1)-th stage SRCn+1 receive carry signals of the previous stages SRC1 to SRCn, respectively.

The second input terminal IN2 receives an output signal of a next stage or the vertical start signal STV. The second input terminal IN2 of the first stage SRC2 to the n-th stage SRCn receive the output signal of the next stages SRC2 to SRCn+1, and the second input terminal IN2 of the dummy stage SRCn+1 receives the vertical start signal STV.

A low voltage VOFF is applied to the voltage terminal VSS.

In an exemplary embodiment, the reset terminal RE receives the carry signal of the dummy stage SRCn+1.

The carry terminal CR is electrically connected to the first input terminal IN1 of the next stage to output the carry signal to the first input terminal IN1 of the next stage.

The output terminal OUT is electrically connected to the corresponding gate line to output a gate signal to the gate line. An odd-numbered gate signal output from the output terminal OUT of the odd-numbered stages SRC1, SRC3, . . . , SRCn+1 is output when the first clock signal CK has a high level voltage. An even-numbered gate signal output from the output terminal OUT of the even-numbered gate stages SRC2, SRC4, . . . , SRCn is output when the second clock signal CKB has the high level voltage. Accordingly, the driving stages SRC1 to SRCn+1 sequentially output the gate signals.

Figure 3:
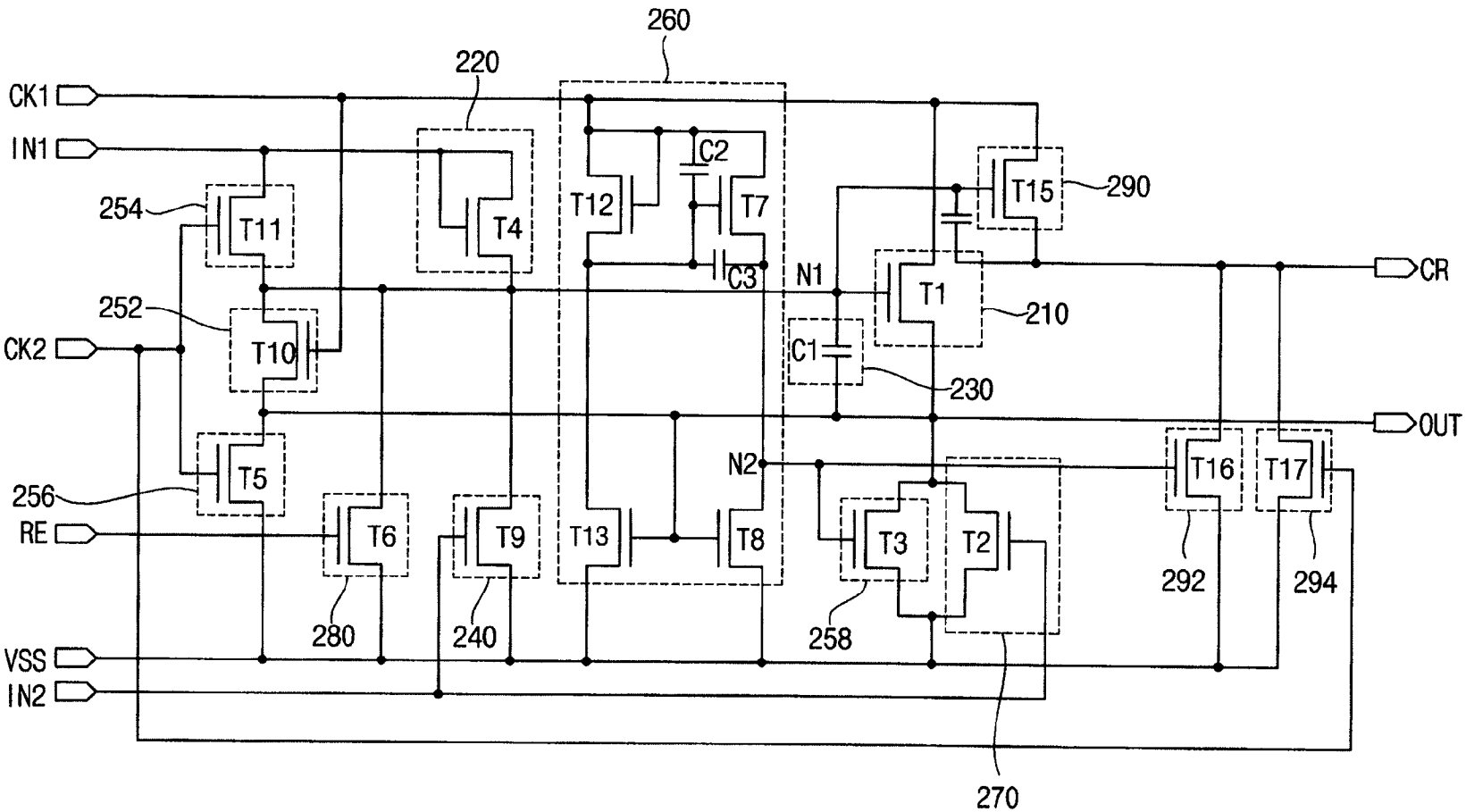
FIG. 3 is a circuit diagram illustrating an exemplary embodiment of a stage of the gate drive circuit of FIG. 2.
Figure 4:
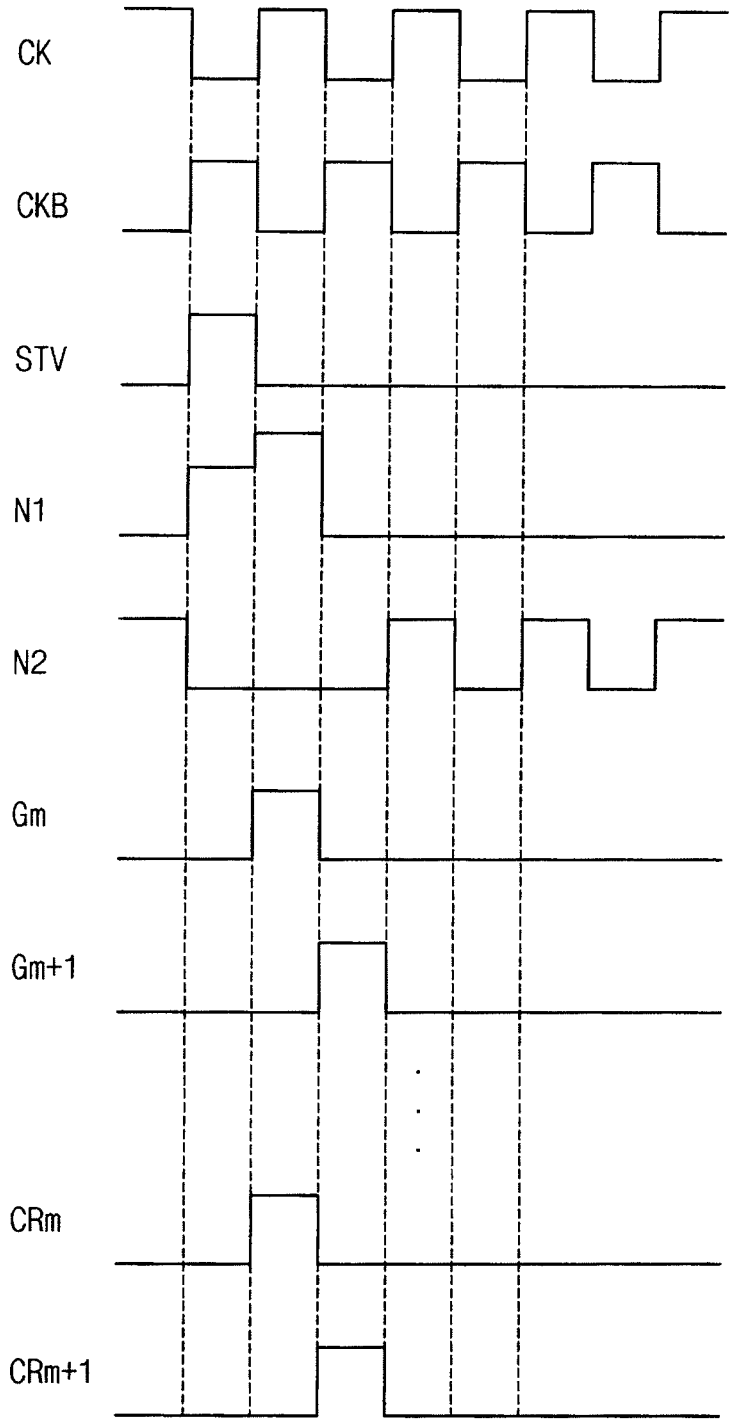
FIG. 4 is a waveform diagram showing input/output signals of the stage of FIG. 3.

FIG. 3 is a circuit diagram illustrating one stage of the gate drive circuit 200 of FIG. 2. FIG. 4 is a waveform diagram showing input/output signals of the stage of FIG. 3.

Referring to FIGS. 3 and 4, the m-th stage SRCm includes a pull-up driving section, a pull-up part 210, a first holding section 252, a second holding section 254, a third holding section 256, a fourth holding section 258, a switching section 260, a pull-down section 270, a reset section 280, a carry section 290, a first carry holding section 292 and a second carry holding section 294. The pull-up driving section includes a buffer part 220, a charging part 230 and a discharging part 240.

The pull-up part 210 includes a first transistor T1. The first transistor T1 includes a drain electrode connected to the first clock terminal CK1, a gate electrode connected to the first node N1 and a source electrode connected to the output terminal OUT. The pull-up part 210 outputs a high level voltage applied to the first clock terminal CK1 as the gate signal, based on a signal voltage of the first node N1.

The pull-up driving part turns on the pull-up part 210 in response to the first input signal of the high level applied to the first input terminal IN1, and turns off the pull-up part 210 in response to the second input signal of the high level applied to the second input terminal IN2. Here, the first input signal is a carry signal of one of the previous stages of the m-th stage SRCm or the vertical start signal STV, and the second input signal is a gate signal of one of the next stages of the m-th stage SRCm. For example, the first input signal is the carry signal of the (m−1)-th stage SRCm−1, and the second input signal is the gate signal Gm+1 of the (m+1)-th stage SRCm+1.

The buffer part 220 includes a fourth transistor T4. The fourth transistor T4 includes a gate electrode and a drain electrode commonly connected to the first input terminal IN1 and a source electrode connected to the first node N1.

The charging part 230 includes a capacitor C1 having a first electrode connected to the first node N1 and a second electrode connected to the output terminal OUT. The charging part 230 charges a high voltage of the first input signal applied to the first input terminal IN1 to maintain the first node N1 at the high level.

The discharging part 240 includes a ninth transistor T9. The ninth transistor T9 includes a gate electrode connected to the second input terminal IN2, a source electrode connected to the voltage terminal VSS and a drain electrode connected to the first node N1.

When the fourth transistor T4 is turned on in response to the carry signal of the (m−1)-th stage SRCm−1, the carry signal is applied to the first node N1 to charge the charging part 230. The charging part 230 is charged with a voltage higher than the threshold voltage of the first transistor T1. When the first clock signal CK has the high voltage, the first transistor T1 is bootstrapped to output the first clock signal CK of the high level to the output terminal OUT.

When the ninth transistor T9 is turned on in response to the high level of the second input signal, the charging part 230 is discharged to a level of the low voltage VOFF applied to the voltage terminal VSS to turn off the first transistor T1.

The first holding section 252 includes a tenth transistor T10. The tenth transistor T10 includes a gate electrode connected to the first clock terminal CK1, a source electrode connected to the first node N1 and a drain electrode connected to the output terminal OUT. In addition, the second holding section 254 includes an eleventh transistor T11. The eleventh transistor includes a gate electrode connected to the second clock terminal CK2, a source electrode connected to the first node N1 and a drain electrode connected to the first input terminal IN11.

The first and the second holding sections 252, 254 maintain the signal of the first node N1 at the level of the low voltage VOFF. For example, when the m-th gate signal Gm is shifted to the level of the low voltage VOFF by the pull-down section 270, and the tenth transistor T10 of the first holding section 252 is turned on in response to the first clock signal CK, the holding section 252 applies the m-th gate signal Gm discharged to the level of the low voltage VOFF to the first node N1, to maintain the level of the first node N1 at the level of the low voltage VOFF. Also, the eleventh transistor T11 is turned on in response to the second clock signal CKB, the second holding section 254 applies the first input signal of the low voltage VOFF to the first node N1 to maintain the level of the first node N1 at the level of the low voltage VOFF.

The third holding section 256 includes a fifth transistor T5. The fifth transistor T5 includes a gate electrode connected to the second clock terminal CK2, a source electrode connected voltage terminal VSS and a drain electrode connected to the output terminal OUT. The third holding section 256 maintains the voltage of the output terminal OUT at the low voltage VOFF in response to the second clock signal CKB.

The fourth holding section 258 includes a third transistor T3. The third transistor T3 includes a gate electrode connected to the second node N2, a source electrode connected to the voltage terminal VSS, a drain electrode connected to the output terminal OUT. The fourth holding section 258 maintains the voltage of the output terminal OUT at the low voltage VOFF in response to the high voltage applied to the second node N2.

The switching section 260 includes a seventh transistor T7, an eighth transistor T8, a twelfth transistor T12, a thirteen transistor T13, a second capacitor C2 and a third capacitor C3.

The seventh transistor T7 includes a drain electrode connected to the first clock terminal CK1, a gate electrode connected to the first clock terminal CK1 through the second capacitor C2 and a source electrode connected to the second node N2. The capacitor C3 is connected between the gate electrode and the source electrode of the seventh transistor T7.

The eighth transistor T8 includes a gate electrode connected to the output terminal OUT, a drain electrode connected to the second node N2, and a source electrode connected to the voltage terminal VSS.

The twelfth transistor T12 includes a gate electrode and a drain electrode commonly connected to the first clock terminal and a source electrode connected to the drain electrode of the thirteenth transistor T13.

A gate electrode of the thirteenth transistor T13 is connected to the output terminal OUT and a source electrode is connected to the voltage terminal VSS.

While the m-th gate signal Gm is maintained at the high voltage in one frame, the thirteenth and eighth transistors T13, T8 of the switching section 260 are turned on, and the potential of the second node N2 is maintained at the low value. Accordingly, since the third transistor T3 is turned off, the voltage terminal VSS and the output terminal of the m-th stage are electrically separated. Thus, the m-th gate signal is not discharged to the low voltage VOFF and is entirely output to the output terminal OUT.

While the m-th gate signal Gm is maintained at the low voltage in one frame, since the thirteenth and the eighth transistor T13, T8 of the switching section 260 are turned off, a signal, of which the phase is the substantially the same as the first clock signal CK received to the first clock terminal CK1, is applied to the second node N2. When the potential of the second node N2 is converted to the high level, the third transistor T3 is turned on, and thus the potential of the output terminal OUT is discharged to the low voltage VOFF.

The pull-down section 270 includes a second transistor T2. The second transistor T2 includes a gate electrode connected to the second input terminal IN2, a source electrode connected to the voltage terminal VSS and a drain electrode connected to the output terminal OUT. The pull-down section 270 pulls down the voltage of the output terminal OUT to the low voltage OFF applied to the voltage terminal VSS in response to the gate signal Gm+1 of the (SRCm+1) applied to the second input terminal IN2.

The reset section 280 includes a sixth transistor T6. The sixth transistor T6 includes a gate electrode connected to the reset terminal RE, a source electrode connected to the voltage terminal VSS and a drain electrode connected to the first node N1. The reset section 280 discharges the voltage of the first node N1 to the low voltage VOFF applied to the voltage terminal VSS, when the carry signal of the dummy stage SRCn+1 which is a last stage is received to the reset terminal RE.

The carry section 290 includes a fifteenth transistor T15. The fifteenth transistor T15 includes a gate electrode connected to the first node N1, a source electrode connected to the carry terminal CR, and a drain electrode connected to the first clock terminal CK1. The carry section 290 outputs the high voltage of the first clock signal CK as the carry signal, when the potential of the first node N1 is converted to the high level.

Since the carry section 290 applies the first clock signal CK of the first clock terminal CK1, with separately the m-th gate signal, to the (m+1)-th stage SRCm+1 which is the next stage through the fifteenth transistor T15, the carry section 290 outputs a normal carry signal without a signal distortion to normally operate the next stage.

The first carry holding section 292 includes a sixteenth transistor T16. The sixteenth transistor T16 includes a gate electrode connected to the second node N2, a source electrode connected to the voltage terminal VSS and a drain electrode connected to the carry terminal CR. The first carry holding section 292 maintains the carry signal CRm output to the carry terminal CR at the low voltage VOFF applied to the voltage terminal VSS, in response to the high voltage applied to the second node N2 in accordance with the first clock signal CK while the m-th gate signal Gm has the low voltage VOFF.

The second carry holding section 294 includes a seventeenth transistor T17. The seventeenth transistor T17 includes a gate electrode connected to the second clock terminal CK2, a source electrode connected to the voltage terminal VSS and a drain electrode connected to the carry terminal CR. The second carry holding section 294 maintains the carry signal CRm output to the carry terminal CR at the low voltage VOFF applied to the voltage terminal VSS in response to the high voltage of the second clock signal CKB applied to the second clock terminal CK2.

As described above, since the first clock signal CK and the second clock signal CKB have opposite phases, the exemplary embodiment of present invention has an effect in that the first and the second carry holding section 292, 294 may stably maintain the carry signal CRm at the low voltage VOFF, without an interval period in which the m-th gate signal Gm has the high voltage and the first clock signal CK has the high voltage.

For example, to maximize a stabilization effect of the carry signal CRm, in an exemplary embodiment the ratio of a channel width W of the sixteenth transistor T16 to the channel width W of the fifteenth transistor T15 is substantially the same as the ratio of the channel width W of the third transistor T3 to the channel width W of the first transistor T1. Also, in an exemplary embodiment the ratio of a channel width W of the seventeenth transistor T17 to the channel width W of the fifteenth transistor T15 is substantially the same as the ratio of the channel width W of the fifth transistor T5 to the channel width W of the first transistor T1. When it is considered that the carry signal CRm and the gate signal Gm output substantially the same signals, the channel width W is implemented using the above-mentioned method because the role and the structure of the fifth transistor T15 are similar to the role and the structure of the first transistor T1, and the role and the structure of the sixth transistor T16 are similar to the role and the structure of the first transistor T3.

According to the exemplary embodiment, since the carry signal applied to the next stage may be stably maintained during the remaining interval period excluding the interval period in which the corresponding gate signal is maintained at the high voltage through the first and the second carry holding parts 292, 294, ripple generation in the carry signal is reduced.

Figure 5:
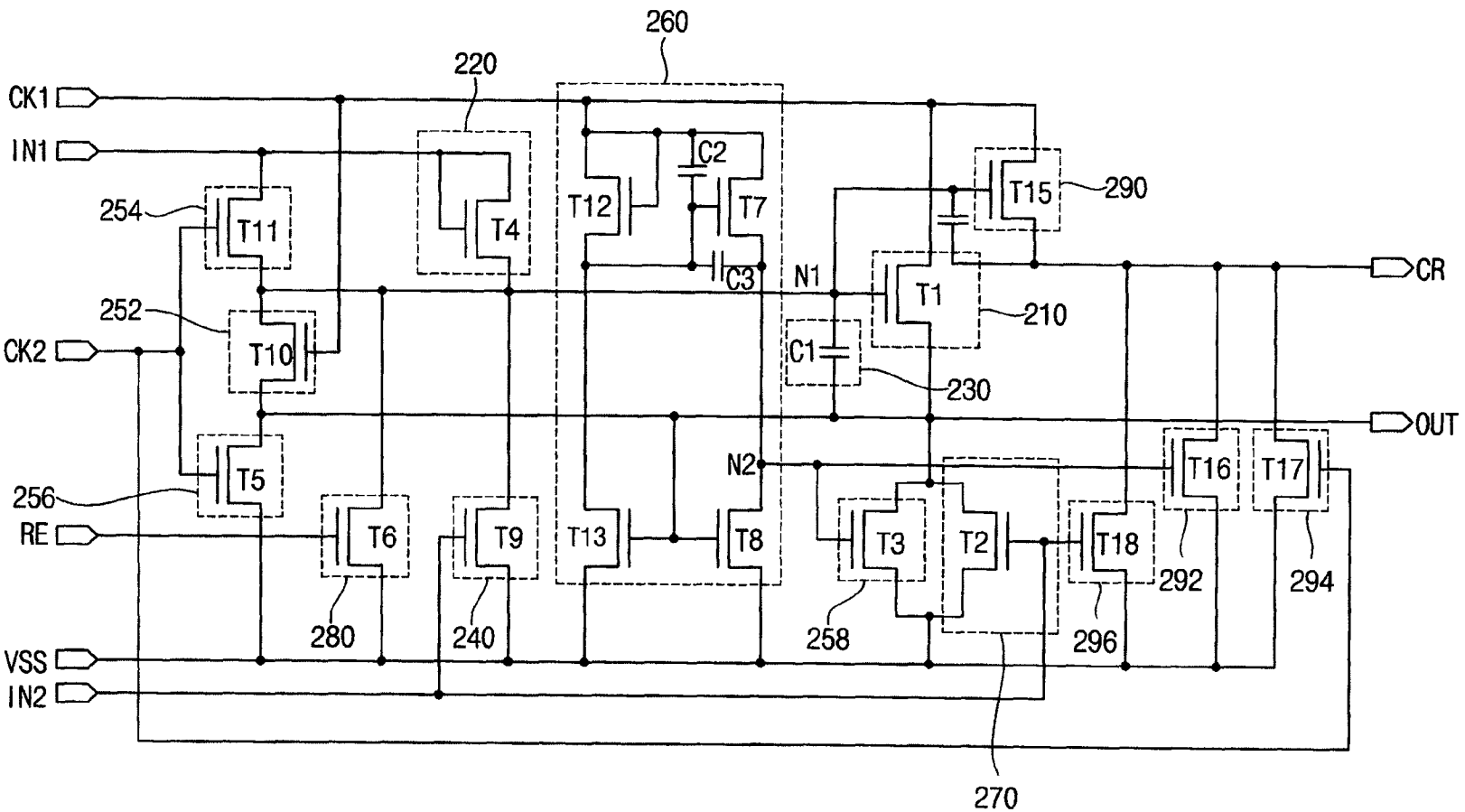
FIG. 5 is a circuit diagram illustrating an exemplary embodiment of a stage of the gate drive circuit of FIG. 2.

FIG. 5 is a circuit diagram illustrating an exemplary embodiment of one stage of the gate drive circuit of FIG. 2.

Since the stage according to an exemplary embodiment depicted in FIG. 5 is substantially the same as the circuit diagram illustrating the stage of FIG. 3 except for the third carry holding section 296, a detailed explanation of the previously described portions will not be repeated.

Referring to FIG. 5, the m-th stage SRCm includes a pull-up driving section, a pull-up part 210, a first holding section 252, a second holding section 254, a third holding section 256, a fourth holding section 258, a switching section 260, a pull-down section 270, a reset section 280, a carry section 290, a first carry holding section 292, a second carry holding section 294 and a third carry holding section 296. The pull-up driving section includes a buffer part 220, a charging part 230 and a discharging part 240.

The third carry holding section 296 includes an eighteenth transistor T18. The eighteenth transistor T 18 includes a gate electrode connected to the second input terminal IN2, a source electrode connected to the voltage terminal VSS and a drain electrode connected to the carry terminal CR. The third carry holding section 296 maintains the carry signal CRm output to the carry terminal CR at the low voltage VOFF applied to the voltage terminal VSS in response to the gate signal Gm+1 of the (m+1)-th stage SRCm+1 applied to the second input terminal IN2.

High-temperature noise may be further increased by moving from one stage to the next stage. Accordingly, when noise such as ripples is generated directly after the carry signal is output in the corresponding stage, the noise needs to be removed so as to not be moved to the next stage. According to the exemplary embodiment, the noise is removed so as to not be moved to the next stage directly after the carry signal is output through the third carry holding part 296, thereby reducing the high temperature noise.

In accordance with an exemplary embodiment the ratio of a channel width W of the eighteenth transistor T18 to the channel width W of the fifteenth transistor T15 is substantially the same as the ratio of the channel width W of the second transistor T2 included in the pull-down part 270 to the channel width W of the first transistor T1 included in the pull-up part 210.

According to the exemplary embodiment, since the carry signal applied to the next stage is stably maintained during the remaining interval period excluding the interval period in which the corresponding gate signal is maintained at the high voltage through the first to the third carry holding part 292, 294, 296, ripple generation in the carry signal is reduced. Also, since the exemplary embodiment improves the high temperature margin of the gate drive circuit, the driving reliability of the gate drive circuit when driven for a long time is improved.

Figure 6A:
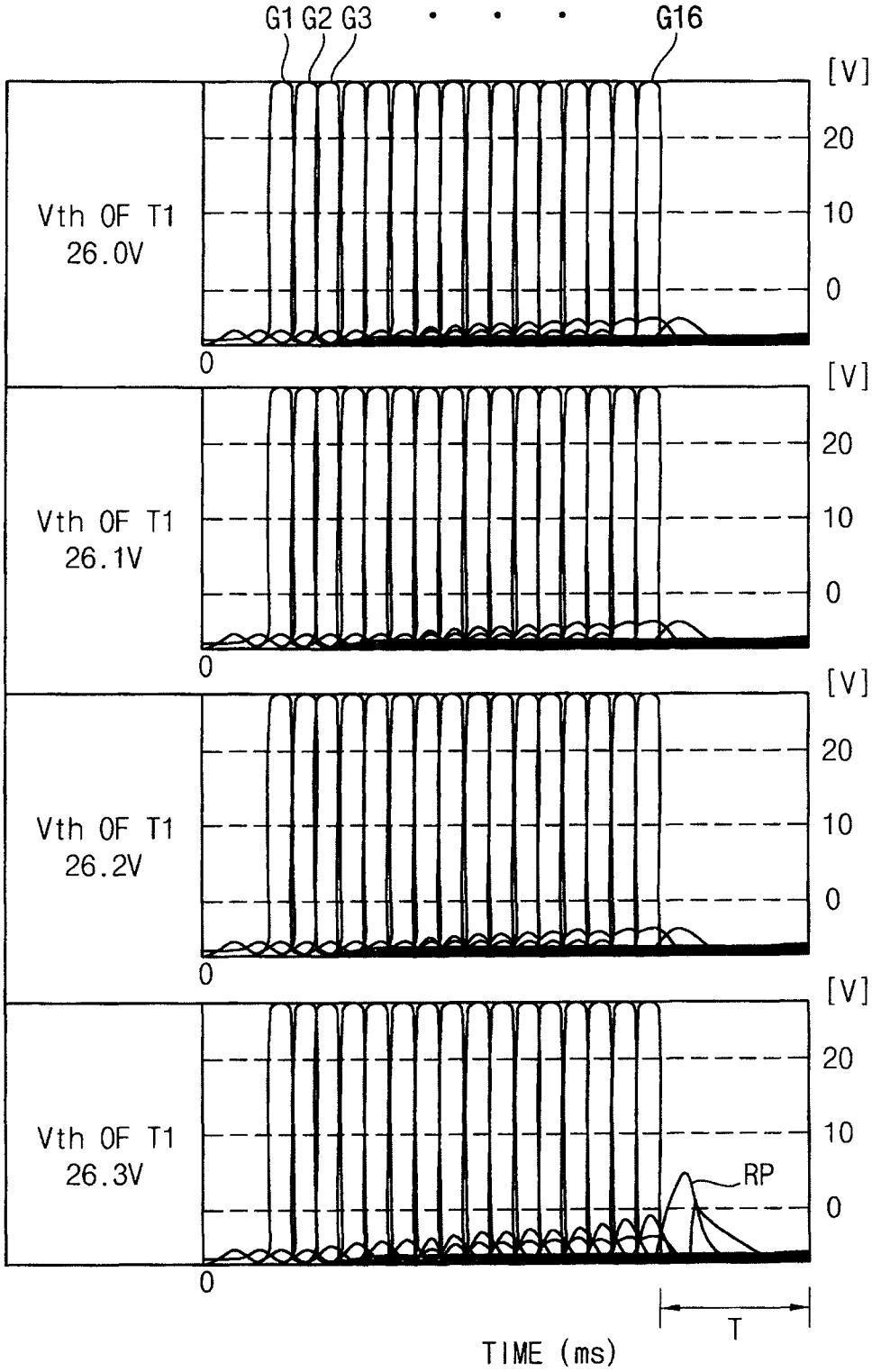
FIGS. 6A, 6B and 6C are waveform diagrams providing a comparison of a high temperature margin of the stages of FIGS. 3 and 5 with a high temperature margin of a stage according to a comparative example.
Figure 6B:
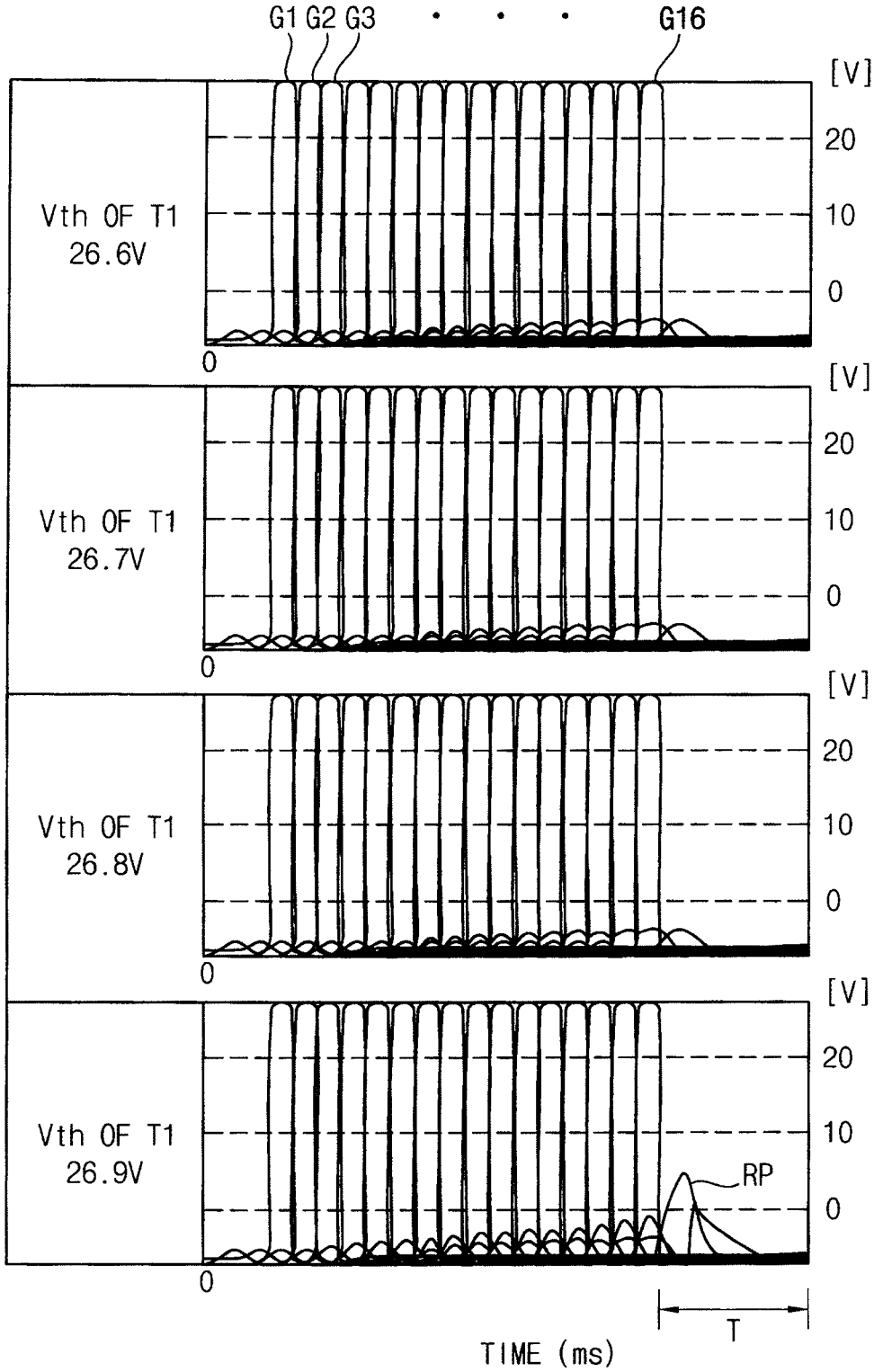
Figure 6C:
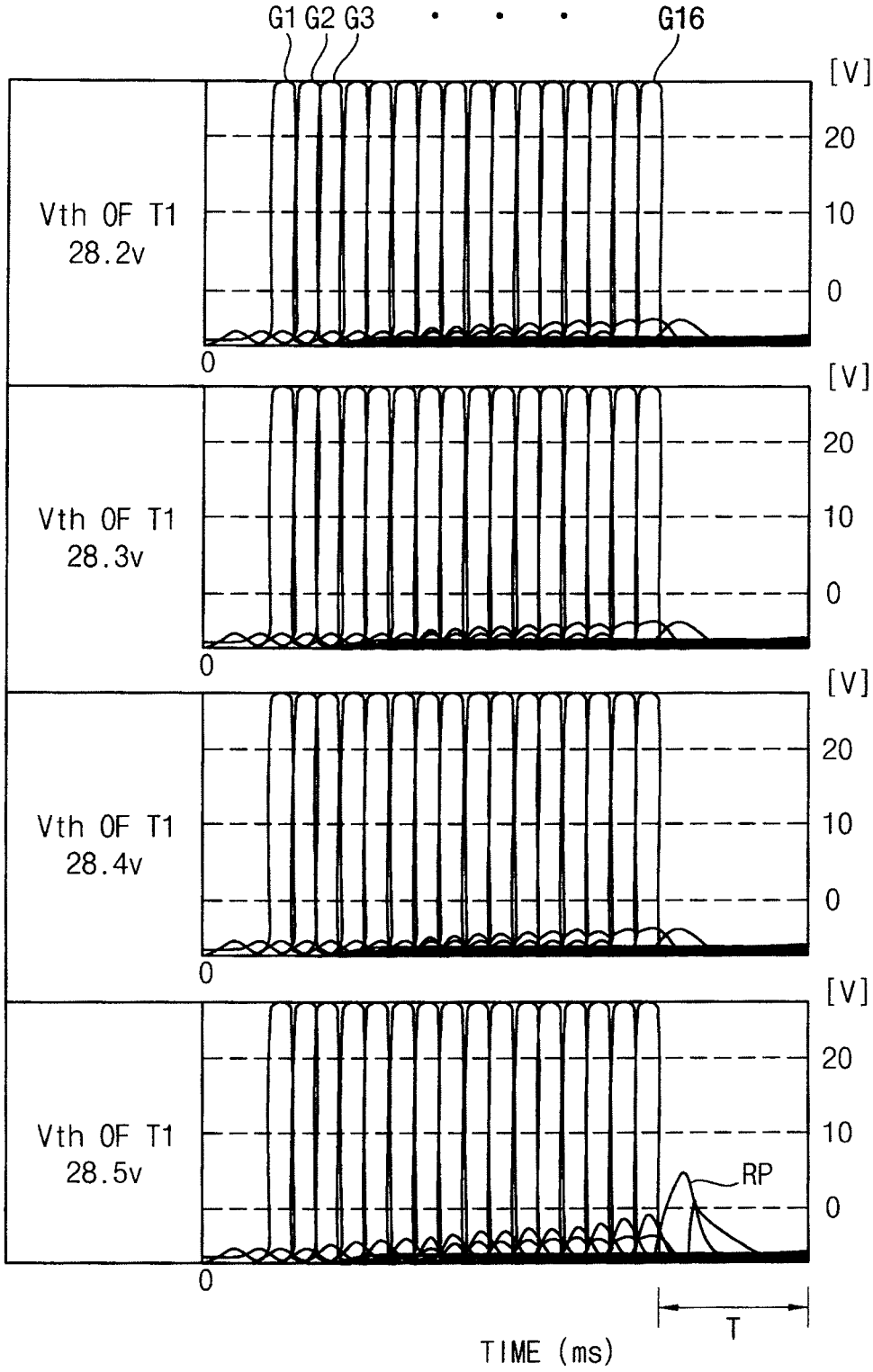

FIGS. 6A to 6C are waveform diagrams showing results of a simulation comparing a high temperature margin of the stages of FIGS. 3 and 5 with the high temperature margin of a stage according to a comparative example.

FIG. 6A is a waveform diagram showing the results of the simulation for confirming the high temperature margin of the stage according to the comparative example. FIG. 6B is a waveform diagram showing the results of the simulation for confirming the high temperature margin of the stage of FIG. 3. FIG. 6B is a waveform diagram showing the results of the simulation for confirming the high temperature margin of the stage of FIG. 5.

Since the stage according to the comparative example is merely that in which the first and the second carry holding parts have been removed from the stage of the exemplary embodiment of FIG. 3, the explanation related to the comparative example stage will be not be repeated.

While the threshold voltage Vth of the first transistor T1 included in the pull-up section is sequentially increased in a state in which an operational frequency is fixed at 45 Hz to obtain the high temperature margin of the stages, the gate signals output to the output terminal are measured.

As shown in FIG. 6A, according to the stage of the comparative example, it can be seen that the ripple RP is generated in the interval in which the gate signal is maintained at the low voltage when the threshold voltage Vth of the first transistor T1 is 26.3 V. For example, the interval T in which the gate signal is maintained at the low voltage is a blank interval between frames. Until the threshold voltage Vth of the first transistor T1 is 26.2 V, it can be seen that the ripple is not generated in the gate signal, and the gate signal is normally output. Accordingly, the high temperature margin of the stage of the comparative example becomes 26.2 V which is a voltage directly before the ripple is generated.

However, as shown in FIG. 6B, according to the stage of an exemplary embodiment of the present invention, it can be seen that the ripple RP is generated in the section T which the gate signal is maintained at the low voltage when the threshold voltage Vth of the first transistor T1 is 26.9 V. For example, it can be seen that until the threshold voltage Vth of the first transistor T1 is 26.8 V, the ripple is not generated in the gate signal, and the gate signal is normally output. Accordingly, the high temperature margin of the stage according to an exemplary embodiment of the present invention becomes 26.8 V which is a voltage directly before the ripple is generated.

Also, as shown in FIG. 6C, according to the stage of an exemplary embodiment of the present invention, it can be seen that the ripple RP is generated in the interval in which the gate signal is maintained at the low voltage when the threshold voltage Vth of the first transistor T1 is 28.5 V. For example, it can be seen that until the threshold voltage Vth of the first transistor T1 is 28.4 V, the ripple is not generated in the gate signal, and the gate signal is normally output. Accordingly, the high temperature margin of the stage according to an exemplary embodiment of the present invention becomes 28.4 V.

It can be seen that when the first and the second carry holding sections 292, 294 are employed, the high temperature margin of the stage according to an exemplary embodiment of the present invention as compared to that of the stage according to the comparative example is improved by about 0.3 V. However, it can be seen that when the first, the second and the third carry holding sections 292, 294, 296 are employed in an exemplary embodiment, the high temperature margin of the stage according to the exemplary embodiment as compared to that of the stage according to the comparative example is improved by about 2.2 V.

Figure 7A:
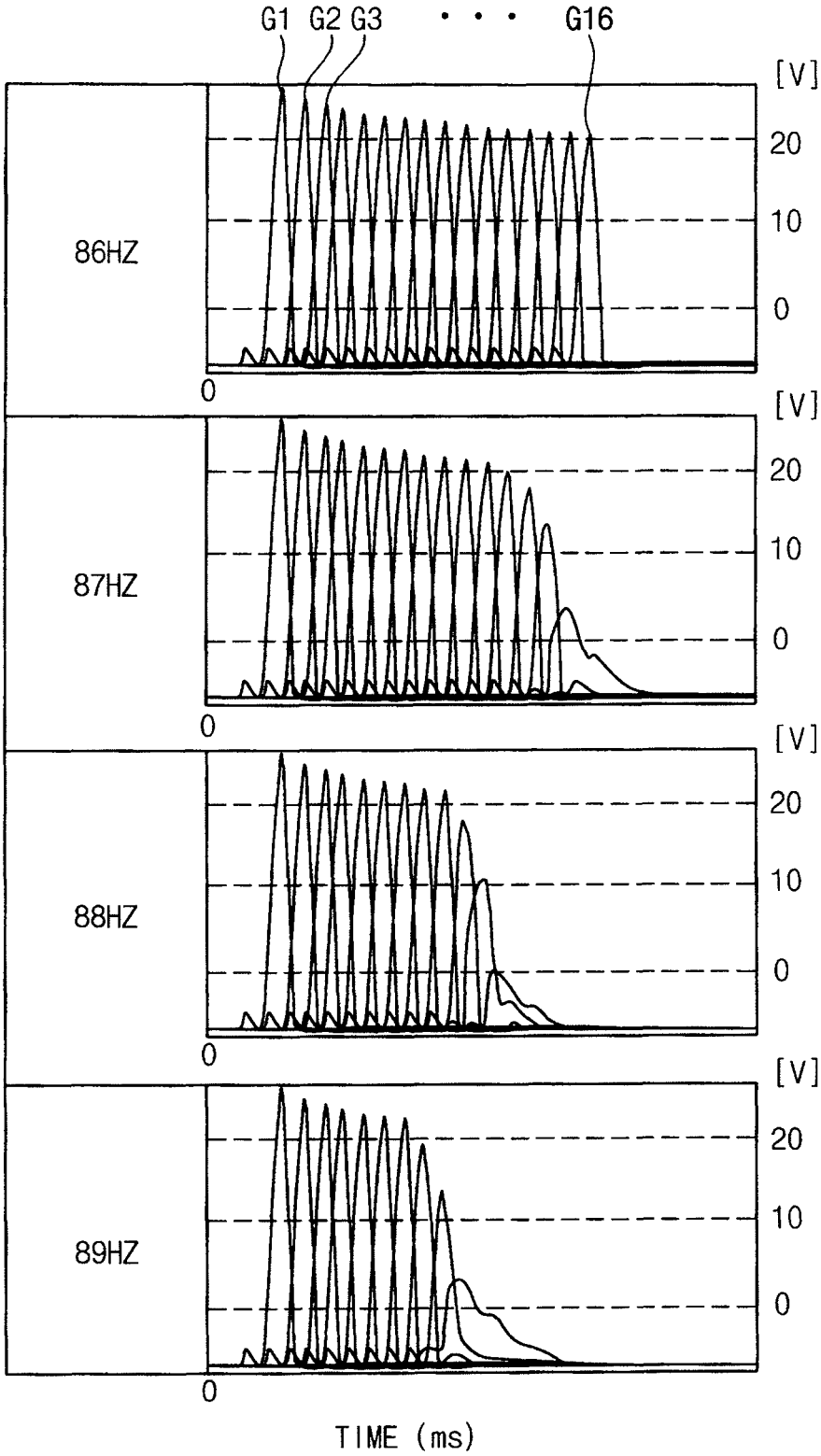
FIGS. 7A, 7B and 7C are waveform diagrams providing a comparison of a low temperature margin of the stage of FIG. 3 and FIG. 5 with a low temperature margin of the stage according to the comparative example.
Figure 7B:
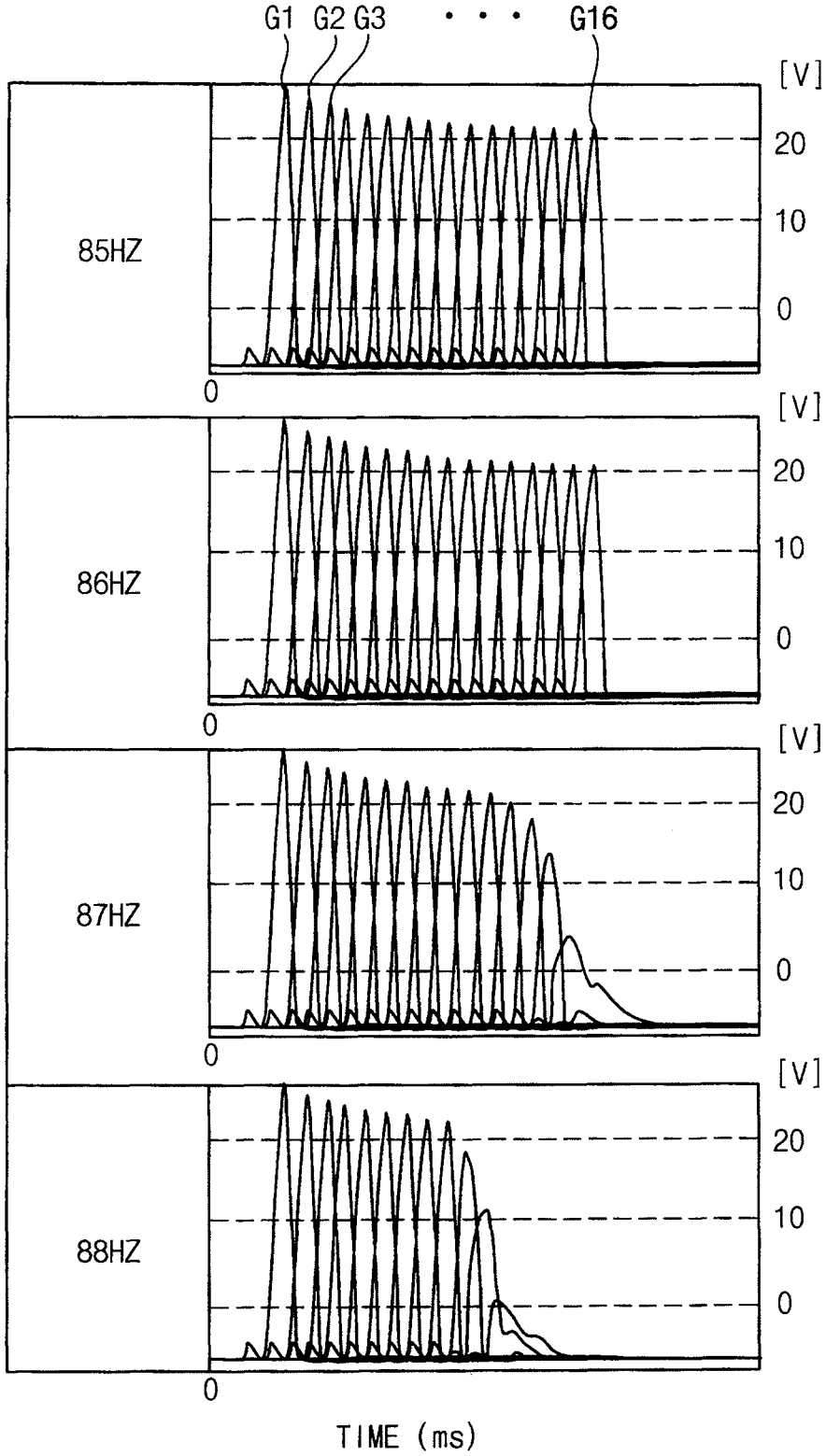
Figure 7C:
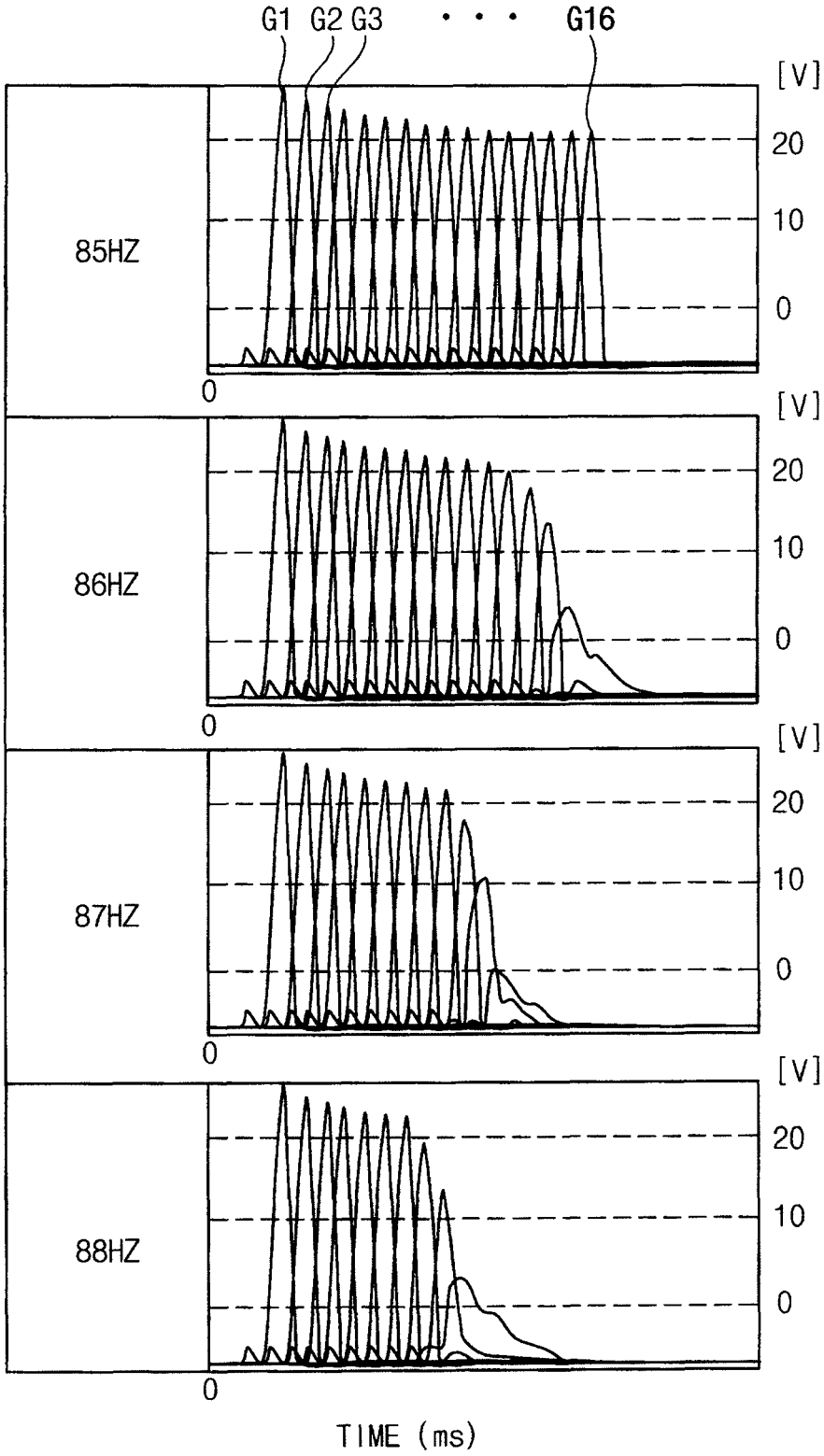

FIGS. 7A to 7C are waveform diagrams showing results of a simulation comparing a low temperature margin of the stages of FIG. 3 and FIG. 5 with the low temperature margin of the stage according to the comparative example.

FIG. 7A is a waveform diagram showing simulation results of a low temperature margin of the stage according to a comparative example. FIG. 7B is a waveform diagram showing the simulation results of a low temperature margin of the stage of FIG. 3. FIG. 7C is a waveform diagram showing the simulation results of a low temperature margin of the stage of FIG. 5.

First, since the stage of the comparative example is the same as a stage in which the first and the second carry holding sections are removed from the stage of the example of FIG. 3, an explanation of the stage of the comparative example will not be repeated.

While an operational frequency is sequentially increased in a state in which the threshold voltage Vth of the first transistor T1 is fixed at about 2 V to obtain the low temperature margin of the stages, the gate signals output to the output terminal are measured.

As shown in FIG. 7A, according to the stage of the comparative example, it can be seen that the gate signals are normally output as the high voltage that is higher than about 20 V when the operational frequency is 86 Hz, while some gate signals are output as voltages lower than 20 V when the operational frequency is 87 Hz. Accordingly, the low temperature margin according to the stage of the comparative example is 86 Hz at which all the high voltages of the gate signals are output at higher than about 20 V.

As shown in FIG. 7B, according to the stage of an exemplary embodiment of the present invention, it can be seen that the gate signals are normally output as the high voltage at higher than about 20 V when the operational frequency is 86 Hz, while some gate signals are output as voltages lower than 20 V when the operational frequency is 87 Hz. Accordingly, the low temperature margin according to the stage of the example of the present invention is 86 Hz at which all the high voltages of the gate signals are output at higher than 20 V.

As shown in FIG. 7C, according to the stage of an exemplary embodiment of the present invention, when the operational frequency is 85 Hz, while some gate signals of the gate signals are output as voltages lower than 20 V if the operational frequency is 86 Hz, it can be seen that the gate signals are normally output as the high voltage at higher than about 20 V. Accordingly, the low temperature margin according to the stage of the example of the present invention is 85 Hz at which all the high voltages of the gate signals are output at higher than 20 V.

When the first and the second carry holding sections are employed in an exemplary embodiment of the present invention, it can be seen that the low temperature margin of the exemplary embodiment is the same as the low temperature margin of the stage according to the comparative example. When the first, second and the third carry holding sections are employed in an exemplary embodiment, it can be seen that the low temperature margin of the example is about 1 Hz lower than the low temperature margin of the stage according to the comparative example. However, the low temperature is generally estimated in 2 Hz units. Accordingly, since reduction of about 1 Hz is a very small amount, it may be estimated that the low temperature margin is constant. In addition, the low temperature and the high temperature usually have a trade-off relationship. However, according to the exemplary embodiments, the low temperature margin may be maintained, while the high temperature margin may be improved.

Figure 8:
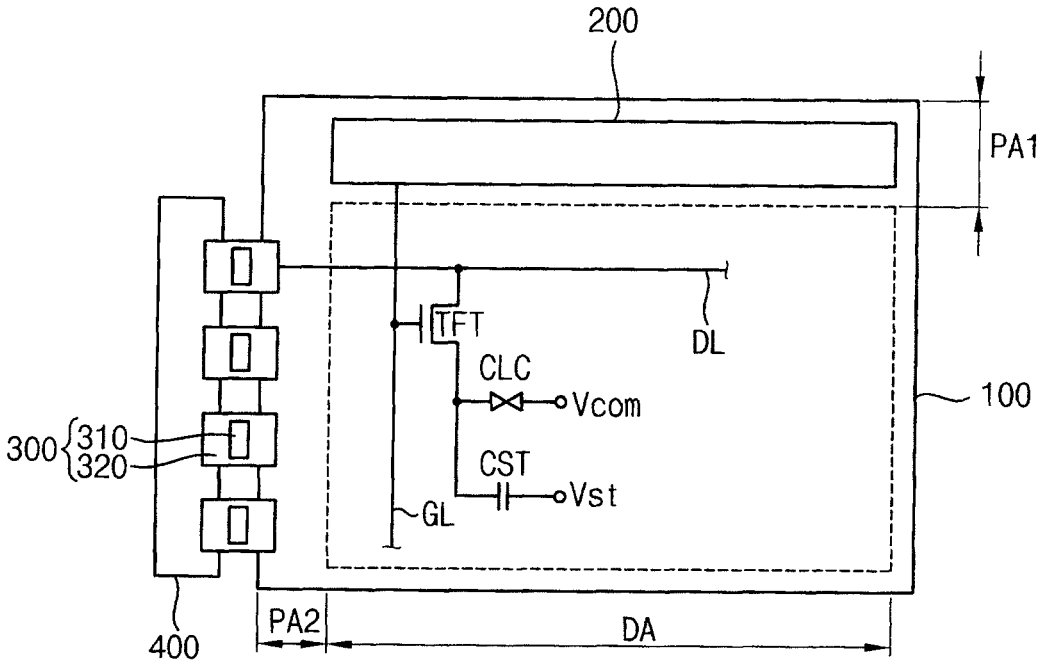
FIG. 8 is a block diagram illustrating a display apparatus according to an exemplary embodiment of the present invention.

FIG. 8 is a plan view illustrating a display apparatus according to an exemplary embodiment of the present invention.

Since the display apparatus according to the exemplary embodiment is substantially the same as the display apparatus according to the exemplary embodiment shown in FIG. 1 except for an arrangement of the gate drive circuit 200 and the data drive circuit 300, a detailed explanation will not be repeated.

The display panel 100 includes a display area DA and a peripheral area PA surrounding the display area DA. The peripheral area PA includes a first peripheral area PA1 positioned to a long side direction of the display panel 100 and a second peripheral area PA2 positioned to a short side direction of the display panel 100.

Gate lines GL, data lines DL crossing the gate lines GL, and a plurality of pixels P are formed in the display area DA. The gate lines GL extend in a column (short side) direction of the display panel 100 and the data lines DL extend in a row (long side) direction of the display panel 100.

The gate drive circuit 200 is integrated in the first peripheral area PA2.

A portion of the data drive circuit 300 is disposed to the second peripheral area PA2. The data drive circuit 300 includes the FPCB 320 on which the data driving chip 310 and the data driving chip 310 are mounted. The FPCB 320 includes a first end portion connected to the second peripheral area PA2 and a second end portion connected to the PCB 400.

In the exemplary embodiment the data driving chip 310 is mounted on the FPCB 320, but is not limited to the exemplary embodiment. That is, the data driving chip 310 may be mounted on the display panel 100, or the second peripheral area PA2 of the display panel 100.

As described above, according to the exemplary embodiments of the present invention, a carry signal may be stably maintained at a low voltage a remaining interval period excluding an interval period in which a corresponding gate signal is maintained at a high voltage through a carry holding section, thereby improving a high temperature margin of the gate drive circuit. Accordingly, the driving reliability of the gate drive circuit when driven for a long time can be improved.

Although exemplary embodiments of the present invention have been described, those skilled in the art will readily appreciate that many modifications are possible without materially departing from the novel teachings and advantages of the present invention. Accordingly, all such modifications are intended to be included within the scope of the present invention as defined in the following claims.

What is claimed is:

1. A gate drive circuit in which stages of the gate drive circuit are connected one after another to each other, the stages outputting gate signals, an m-th stage, 'm' being a natural number, comprising:

a pull-up section that outputs a first clock signal as a gate signal of the m-th stage to an output terminal in response to a high voltage of a first node signal which is converted into a high level in accordance with a vertical start signal or a carry signal of one of previous stages of the m-th stage;

a pull-down section that applies a low voltage to the output terminal in response to a high voltage of the gate signal of one of next stages of the m-th stage;

a carry section that outputs the first clock signal as a carry signal of the m-th stage in response to the high voltage of the first node signal;

a first carry holding section that maintains the carry signal of the m-th stage at the low voltage in response to the high voltage of the first clock signal when the gate signal of the m-th stage is maintained at the low voltage;

a second carry holding section that maintains the carry signal of the m-th stage at the low voltage in response to a high voltage of a second clock signal having a different phase from the first clock signal, and a third carry holding section that maintains the carry signal of the m-th stage at the low voltage in response to the gate signal of the one of the next stages of the m-th stage, wherein a gate of a transistor of the third carry holding section is directly connected to a terminal that provides the gate signal of the one of the next stages of the m-th stage.

2. The gate drive circuit of claim 1, further comprising a switching section having a second node to which the low voltage is applied when the gate signal of the m-th stage is maintained at the high voltage, and to which the first clock signal is applied when the gate signal of the m-th stage is maintained at the low voltage.

3. The gate drive circuit of claim 2, further comprising:

a first holding section that applies the low voltage to the output terminal in response to the high voltage of the first clock signal applied to the second node; and a second holding section that applies the low voltage to the output terminal in response to the high voltage of the second clock signal.

4. The gate drive circuit of claim 3, wherein:

the pull-up section comprises a first transistor having a gate electrode connected to the first node, a source electrode connected to the output terminal and a drain electrode connected to a first clock terminal that receives the first clock signal, a fourth holding section comprises a second transistor having a gate electrode connected to the second node, a source electrode connected to a voltage terminal that receives the low voltage and a drain electrode connected to the output terminal, the carry section comprises a third transistor having a gate electrode connected to the first node, a source electrode connected to a carry terminal that outputs the carry signal of the m-th stage to the one of the next stages of the m-th stage and a drain electrode connected to the first clock terminal, and the first carry holding section comprises a fourth transistor having a gate electrode connected to the second node, a source electrode connected to the voltage terminal and a drain electrode connected to the carry terminal.

5. The gate drive circuit of claim 4, wherein a ratio of a channel width of the second transistor to a channel width of the first transistor is substantially the same as a ratio of a channel width of the fourth transistor to a channel width of the third transistor.

6. The gate drive circuit of claim 4, wherein:

the second holding section comprises a fifth transistor having a gate electrode connected to a second clock terminal that receives the second clock signal, a source connected to the voltage terminal and a drain electrode connected to the output terminal, and a second carry holding section comprises a sixth transistor having a gate electrode connected to the second clock terminal, a source electrode connected to the voltage terminal and a drain electrode connected to the carry terminal.

7. The gate drive circuit of claim 6, wherein a ratio of a channel width of the fifth transistor to the channel width of the first transistor is substantially the same as a ratio of a channel width of the sixth transistor to a channel width of the third transistor.

8. The gate drive circuit of claim 4, wherein:

the pull-down section comprises a seventh transistor having a gate electrode connected to a second input terminal that receives the gate signal of the one of the next stages, a source electrode connected to the voltage terminal and a drain electrode connected to the output terminal, and the third carry holding section comprises an eighth transistor having a gate electrode connected to the second input terminal, a source electrode connected to the voltage terminal and a drain electrode connected to the carry terminal.

9. The gate drive circuit of claim 8, wherein a ratio of a channel width of the seventh transistor to a channel width of the first transistor is substantially the same as a ratio of a channel width of the eighth transistor to a channel width of the third transistor.

10. A display apparatus comprising:

a display panel having gate lines and data lines that cross the gate lines, the display panel comprising a display area that displays an image and a peripheral area that surrounds the display area;

a data drive circuit that outputs data signals to the data lines; and a gate drive circuit in which a plurality of stages are connected one after another to each other, the stages outputting gate signals, an m-th stage, 'm' being a natural number, comprising:

a pull-up section that outputs a first clock signal as a gate signal of the m-th stage to an output terminal in response to a high voltage of a first node signal which is converted into a high level in accordance with a vertical start signal or a carry signal of one of previous stages of the m-th stage;

a pull-down section that applies a low voltage to the output terminal in response to a high voltage of the gate signal of one of next stages of the m-th stage;

a carry section that outputs the first clock signal as a carry signal of the m-th stage in response to the high voltage of the first node signal;

a first carry holding section that maintains the carry signal of the m-th stage at the low voltage in response to the high voltage of the first clock signal when the gate signal of the m-th stage is maintained at the low voltage;

a second carry holding section that maintains the carry signal of the m-th stage at the low voltage in response to a high voltage of a second clock signal having a different phase from the first clock signal; and a third carry holding section that maintains the carry signal of the m-th stage at the low voltage in response to the gate signal of the one of the next stages of the m-th stage, wherein a gate of a transistor of the third carry holding section is directly connected to a terminal that provides the gate signal of the one of the next stages of the m-th stage.

11. The display apparatus of claim 10, wherein the gate drive circuit is disposed on the peripheral area positioned to a short side direction of the display panel, and the data drive circuit is disposed on the peripheral area positioned to a long side direction of the display panel.

12. The display apparatus of claim 10, wherein the gate drive circuit is disposed on the peripheral area positioned to a long side direction of the display panel, and the data drive circuit is disposed on the peripheral area positioned to a short side direction of the display panel.

13. The display apparatus of claim 10, wherein the gate drive circuit further comprises a switching section having a second node to which the low voltage is applied when the gate signal of the m-th stage is maintained at the high voltage, and to which the first clock signal is applied when the gate signal of the m-th stage is maintained at the low voltage.

14. The display apparatus of claim 13, wherein the gate drive circuit further comprises:

a first holding section that applies the low voltage to the output terminal in response to the high voltage of the first clock signal applied to the second node; and a second holding section that applies the low voltage to the output terminal in response to the high voltage of the second clock signal.

15. The display apparatus of claim 14, wherein:

the pull-up section comprises a first transistor having a gate electrode connected to the first node, a source electrode connected to the output terminal and a drain electrode connected to a first clock terminal that receives the first clock signal, a fourth holding section comprises a second transistor having a gate electrode connected to the second node, a source electrode connected to a voltage terminal that receives the low voltage and a drain electrode connected to the output terminal, the carry section comprises a third transistor having a gate electrode connected to the first node, a source electrode connected to a carry terminal that outputs the carry signal of the m-th stage to the one of the next stages of the m-th stage and a drain electrode connected to the first clock terminal, and the first carry holding section comprises a fourth transistor having a gate electrode connected to the second node, a source electrode connected to the voltage terminal and a drain electrode connected to the carry terminal.

16. A first stage, in a gate drive circuit for driving a display panel, for reducing ripple generation between the first stage and a next stage, the first stage comprising:

a pull-up section that outputs a first clock signal as a gate signal of the m-th stage to an output terminal in response to a high voltage of a first node signal which is converted into a high level in accordance with a vertical start signal or a carry signal of one of previous stages of the m-th stage, the pull-up section being a transistor having a pull-up section channel width;

a pull-down section that applies a low voltage to the output terminal in response to a high voltage of the gate signal of one of next stages of the m-th stage, the pull-down section being a transistor having a pull-down section channel width;

a carry section that outputs the first clock signal as a carry signal of the math stage in response to the high voltage of the first node signal, the carry section being a transistor having a carry section channel width;

a first carry holding section that maintains the carry signal of the m-th stage at the low voltage in response to the high voltage of the first clock signal when the gate signal of the m-th stage is maintained at the low voltage;

a second carry holding section that maintains the carry signal of the m-th stage at the low voltage in response to a high voltage of a second clock signal having a different phase from the first clock signal;

a third carry holding section that maintains the carry signal of the m-th stage at the low voltage in response to the gate signal of the one of the next stages of the m-th stage, the third carry holding section being a transistor having a third carry holding section channel width;

wherein a ratio of the third carry holding section channel width to the carry section channel width is substantially the same as a ratio of the pull-down section channel width to the pull-up section channel width, and wherein a gate of a transistor of the third carry holding section is directly connected to a terminal that provides the gate signal of the one of the next stages of the m-th stage.

* * * * *